US005445655A

United States Patent [19]

Kuhn et al.

[11] Patent Number: 5,445,655

[45] Date of Patent: Aug. 29, 1995

[54] AUXILIARY FOR TEXTILE WET FINISHING PROCESSES

[75] Inventors: Martin Kuhn, Dornach, Switzerland; Philippe Ouziel, Altkirch, France

[73] Assignee: Ciba-Geigy Corporation, Ardsley, N.Y.

[21] Appl. No.: 200,981

[22] Filed: Feb. 24, 1994

[30] Foreign Application Priority Data

Mar. 2, 1993 [CH] Switzerland ..... 628/93

[51] Int. Cl.[6] ..... D06M 15/00; D06B 1/00; C09B 67/00

[52] U.S. Cl. ..... 8/555; 8/558; 8/918; 8/922; 8/927

[58] Field of Search ..... 8/555, 558, 917, 918, 8/921, 922, 924

[56] References Cited

U.S. PATENT DOCUMENTS

| | | | |
|---|---|---|---|
| Re. 30,227 | 3/1980 | von Rütte et al. | 252/301.22 |
| 2,803,607 | 8/1957 | Stroh et al. | 260/8 |
| 4,304,567 | 12/1981 | Ballmann et al. | 8/543 |
| 4,433,976 | 2/1984 | von der Elty et al. | 8/555 |
| 4,689,159 | 8/1987 | Makashima | 252/8.6 |
| 4,705,526 | 11/1987 | Abel et al. | 8/555 |
| 4,975,524 | 12/1990 | Berendt | 528/366 |
| 4,997,878 | 3/1991 | Bock et al. | 524/817 |
| 5,093,414 | 3/1992 | Rauterkus et al. | 524/813 |

FOREIGN PATENT DOCUMENTS

| | | | |
|---|---|---|---|
| 019188 | 11/1980 | European Pat. Off. . | |
| 0450688 | 2/1982 | European Pat. Off. . | |
| 164554 | 12/1985 | European Pat. Off. . | |
| 243939 | 11/1987 | European Pat. Off. . | |
| 315876 | 5/1989 | European Pat. Off. . | |
| 364399 | 4/1990 | European Pat. Off. . | |
| 376758 | 7/1990 | European Pat. Off. . | |
| 506613 | 9/1992 | European Pat. Off. . | |
| 2186570 | 1/1974 | France . | |
| 2844250 | 4/1980 | Germany | D06P 1/56 |
| 1422878 | 1/1976 | United Kingdom . | |

OTHER PUBLICATIONS

Chem. Abst. 108:96125s abstract of DE 3,614,905 Nov. 5, 1987.

*Primary Examiner*—Christine Skane
*Assistant Examiner*—Margaret Einsmann
*Attorney, Agent, or Firm*—George R. Dohmann

[57] ABSTRACT

The present invention relates to the use of an acrylamide homopolymer or copolymer in an amount of <0.04 g per liter of dye liquor as anticrease agent in exhaust dyeing processes.

9 Claims, No Drawings

AUXILIARY FOR TEXTILE WET FINISHING PROCESSES

The present invention relates to the use of specific polymers as textile auxiliaries, especially as anticrease agents in exhaust dyeing processes.

Modern piece dyeing is preferably carded out in closed apparatus such as HT winch becks, fully or partially flooded jet dyeing machines or softstream dyeing machines. When dyeing woven and knit fabrics with these machines it is to be expected that creasing will occur, resulting in unlevel dyeings. The cause of such unlevel dyeings is, on the one hand, the variable entry of the dye liquor in the running crease opposite the exposed surface of the fabric and, on the other, the changed dye uptake by the stress-deformed fibres by way of a concurrent change in crystallinity. This problem is countered by adding to the dyebaths auxiliaries, inter alia those listed in Textilhilfsmittelkatalog 1991, Konradin Verlag D-7022 Leinfelden-Echterdingen, pages 103–107. The known anticrease agents, however, are not able in all respects to satisfy the demands made of them. There is therefore a need to provide novel anticrease agents having improved properties.

Surprisingly, it has now been found that specific homopolymers and copolymers are admirably suitable for use as anticrease agents and effectively prevent unlevelness during jet dyeing or dyeing on the winch beck.

Accordingly, the invention relates to the use of acrylamide homopolymers or copolymers in an amount of $<0.04$ g per liter as anticrease agents for exhaust dyeing processes.

The acrylamide homopolymers or copolymers are preferably used in the from of an aqueous formulation.

The polymer used as anticrease agent is typically an acrylamide homopolymer or a copolymer of acrylamide and acrylic acid. The preferred homopolymers and copolymers consist of 70 to 100% by weight of acrylamide and 0 to 30% by weight of acrylic acid, in each case based on the weight of the monomers. It is particularly preferred to use acrylamide/acrylic acid copolymers and, among these, preferably those having an acrylamide content of $>70\%$ by weight, based on the weight of the monomers. A particularly preferred embodiment of the invention relates to the use of copolymers of 75 to 90% by weight of acrylamide and 10 to 25% by weight of acrylic acid, in each case based on the weight of the monomers.

The homopolymers and copolymers used in the practice of this invention have an average molecular weight of typically 800 000 to c. 15 million, preferably from 1 to 10 million and, most preferably, from 1.5 to 3 million.

The homopolymers and copolymers used in the practice of this invention are known per se or can be obtained by known methods. They can be converted into easy to use aqueous formulations by simple addition to, or mixing with, water. It is advantageous to use aqueous solutions or dispersions of the acrylamide homopolymers or copolymers with a solids content of e.g. 0.05 to 10% by weight and, preferably, 0.5 to 3% by weight.

The amounts in which the polymers are added to the treatment liquors, preferably the dyebaths, in the practice of this invention are conveniently in the range from 0.0005 to 0.04 g/l of liquor, preferably from 0.0005 to 0.03 g/l of liquor and, most preferably, from 0.005 to 0.02 g/l of liquor. Amounts of $>0.4$ g/l of liquor are impracticable, because they may result in the formation of a layer of grease on the fabric to be dyed that can only be removed with great difficulty.

Dyeing in the presence of the acrylamide homopolymers or copolymers by an exhaust process is carried out in per se known manner familiar to those skilled in the art using a wide range of fibre materials.

Suitable cellulosic fibre material is that made from regenerated or, preferably, natural cellulose, typically viscose rayon, viscose silk, hemp, linen, jute or, preferably, cotton.

Cellulosic fibre materials are usually dyed with substantive dyes, vat dyes, leuco-vat dye esters or, preferably, reactive dyes.

Suitable substantive dyes are the customary direct dyes, for example those listed in the Colour Index 3rd Edition, (1971) Vol. 2 on pages 2005–2478 under the heading "Direct Dyes".

The vat dyes are higher fused and heterocyclic benzoquinones or naphthoquinones, sulfur dyes and, in particular, anthraquinoids or indigoid dyes. Examples of vat dyes useful in the practice of this invention are listed in the Colour Index 3rd Edition, (1971) Vol. 3 on pages 3649–3837 under the headings "Sulphur Dyes" and "Vat Dyes".

The leuco-vat dye esters are conveniently obtainable from vat dyes of the indigo, anthraquinone or indanthrene series by reduction with e.g. iron powder and subsequent esterification with e.g. chlorosulfonic acid, and are listed in the Colour Index 3rd Edition, (1971) Vol. 3 as "Solubilised Vat Dyes".

By reactive dyes are meant the standard dyes that form a chemical bond with cellulose, typically those listed in the Colour Index 3rd Edition, (1971) Vol. 3 on pages 3391–3560 and in Vol. 6 (revised 3rd Edition 1975) on pages 6268–6345 under the heading "Reactive Dyes".

Synthetic polyamide fibre materials, especially textile materials, that can be dyed in the presence of the novel copolymers are typically those of adipic acid and hexamethylenediamine (polyamide 66), $\epsilon$-caprolactam (polyamide 6), from $\omega$-aminoundecanoic acid (polyamide 11 ), from $\omega$-aminoenanthic acid (polyamide 7), from $\omega$-aminopelargonic acid (polyamide 8) or from sebacic acid and hexamethylenediamine (polyamide 610).

Synthetic or natural polyamide fibre materials are usually dyed with anionic dyes.

The anionic dyes are typically salts of heavy metal-containing or, preferably, metal-free azomethine, monoazo, disazo or polyazo dyes, including formazan dyes, as well as the anthraquinone, xanthene, nitro, triphenylmethane, naphthoquinonimine and phthalocyanine dyes. The ionic character of these dyes may be determined by metal complexing alone and/or preferably by acid, salt-forming substituents such as carboxylic acid groups, sulfuric acid groups and phosphonate groups, phosphonic acid groups or, preferably, sulfonic acid groups. These dyes can also contain in the molecule so-called reactive groupings that form a covalent bond with the material to be dyed. Preferred anionic dyes are the acid metal-free dyes. These last mentioned dyes preferably contain only a single sulfonic acid group and, in some cases, a further water-solubilising, but not salt-forming, group such as the acid amide or alkylsulfonyl group.

Particularly interesting dyes are also the 1:1 or, preferably, 1:2 metal complex dyes. The 1:1 metal complex dyes preferably contain one or two sulfonic acid groups. They contain as metal a heavy metal atom such as a copper, nickel or, preferably, chromium atom.

The 1:2 metal complex dyes contain as central atom a heavy metal atom, typically a cobalt atom or, preferably, a chromium atom. Two complexing components are attached to the central atom, at least one of which components is a dye molecule, but preferably both components are dye molecules. Further, the two complexing dye molecules may be identical or different. The 1:2 metal complex dyes may conveniently contain two azomethine molecules, one disazo dye molecule and one monoazo dye molecule or, preferably, two monoazo dye molecules. The azo dye molecules may contain water-solubilising groups, typically acid amide groups, alkylsulfonyl groups or the acid groups cited above. Preferred 1:2 metal complex dyes are 1:2 cobalt or 1:2 chromium complexes of monoazo dyes that contain acid amide groups, alkylsulfonyl groups or contain altogether a single sulfonic acid group.

Mixtures of the anionic dyes can also be used.

The polyester fibre material that can be dyed or whitened in the presence of the copolymer comprises suitably cellulose esters such as cellulose secondary acetate and cellulose triacetate fibres and, in particular, linear polyester fibres. By linear polyester fibres are meant synthetic fibres that are obtained conveniently by condensation of terephthalic acid with ethylene glycol or of isophthalic acid or terephthalic acid with 1,4-bis(hydroxymethyl)cyclohexane, as well as copolymers of terephthalic acid and isophthalic acid and ethylene glycol. The linear polyester hitherto used almost exclusively in the textile industry consists of terephthalic acid and ethylene glycol.

The disperse dyes to be used for dyeing polyester fibre materials which are only very sparingly soluble in water and are mostly present in the dyeing liquor in tjhe form of a fine dispersion, can belong to a wide range of dye classes, including the acridone, azo, anthraquinone, coumarin, methine, perinone, naphthoquinone-imine, quinophthalone, styryl or nitro dyes. It is also possible to use mixtures of disperse dyes.

The acrylamide homopolymers and copolymers of this invention can also be used with advantage for dyeing polyacrylonitrile fibres with cationic dyes, as no troublesome interactions occur and, in particular, no precipitations are formed. Migrating as well as non-migrating dyes can also be used as cationic dyes.

Migrating cationic dyes are in particular those carrying a partially or completely delocalised positive charge, whose cation weight is lower than 310, whose parachor is lower than 750, and whose log P is smaller than 3.2. The parachor is calculated as described in the article by O. R. Quayle [Chem. Rev. 53, 439 (1953)] and log P denotes the relative lipophily, the calculation of which has been described by C. Hanach et al [J. Med. Chem. 16, 1207 (1973)].

Non-migrating cationic dyes are in particular those whose cation weight is greater than 310 and whose parachor is higher than 750.

The cationic, migrating and non-migrating dyes can belong to to different dye classes. In particular they are salts, typically chlorides, sulfates or metal ha/ides, for example zinc chloride double salts of azo dyes such as monoazo dyes or hydrazone dyes, anthraquinone dyes, diphenylmethane dyes, triphenylmethane dyes, methine dyes, azomethine dyes, coumarin dyes, ketone-imine dyes, cyanine dyes, xanthene dyes, azine dyes, oxazine dyes or thiazine dyes.

Mixtures of the cationic dyes can also be used. Especially preferred are dye combinations of at least two or, preferably, three migrating or non-migrating cationic dyes for producing level dichromatic or trichromatic dyeings, in which case also mixtures of migrating and non-migrating cationic dyes can be used.

The fibre materials can also be used as blends with one another or with other fibres, typically blends of polyacrylonitrile/polyester, polyamide/polyester, polyester/cotton, polyester/viscose, polyacrylonitrile/-wool and polyester/wool.

Blends of polyester and cotton are usually dyed with combinations of disperse dyes and vat dyes, sulfur dyes, leuco-vat ester dyes, direct dyes or reactive dyes, the polyester component being dyed simultaneously or subsequently with disperse dyes.

Polyester/wool blends are preferably dyed in the practice of this invention with commercially available mixtures of anionic dyes and disperse dyes.

The textile material to be dyed can be in any form of presentation and is preferably in the form of piece goods such as knit goods or wovens.

The formulations of this invention can also be used for whitening undyed synthetic fibre materials with fluorescent whitening agents that are dispersed in water. The fluorescent whitening agents may belong to any class of whitener. Preferably they are coumarins, triazole coumarins, benzocoumarins, oxazines, pyrazines, pyrazolines, diphenyl pyrazolines, stilbenes, styryl stilbenes, triazolyl stilbenes, bis(benzoxazoly)-lethylene, stilbene bis(benzoxazoles), phenylstilbene benzoxazoles, thiophene bis(benzoxazoles), naphthalene bis(benzoxazoles), benzofurans, benzimidazoles and naphthalimides.

Mixtures of fluorescent whitening agents can also be used.

The amount of fluorescent whitening agent added to be added to the dye liquor will depend on the desired tinctorial strength. Usually mounts of 0.01 to 10% by weight, preferably 0.2 to 5% by weight, based on the textile material, have been found useful.

Depending on the textile material to be treated, the dyebaths or whitener liquors may contain—in addition to the dyes or fluorescent whitening agents and the novel formulations of copolymers—wool protective agents, oligomer inhibitors, oxidising agents, antifoams, emulsifiers, levelling agents, retarders and, preferably, dispersants.

The dispersants are added in particular to ensure that the disperse dyes are finely dispersed. Suitable dispersants are those customarily used for dyeing with disperse dyes.

Suitable dispersants are preferably sulfated or phosphated polyadducts of 15 to 100 mol of ethylene oxide or preferably propylene oxide with polyhydric alcohols of 2 to 6 carbon atoms, typically ethylene glycol, glycerol or pentaerythritol, or with amines of 2 to 9 carbon atoms having at least two amino groups or one amino group and one hydroxyl group, and also alkylsulfonates of 10 to 20 carbon atoms in the alkyl chain, alkylbenzenesulfonates having a linear or branched alkyl chain of 8 to 20 carbon atoms in the alkyl chain, typically nonylbenzenesulfonate or dodecylbenzenesulfonate, 1,3,5,7-tetramethyloctylbenzenesulfonate or sulfosuccinates such as sodium dioctylsulfosuccinate.

Particularly useful anionic dispersants are ligninsulfonates, polyphosphates and, preferably, condensates of formaldehyde with aromatic sulfonic acids, condensates of formaldehyde with monofunctional or bifunctional phenols, for example with cresol, β-naphtholsulfonic acid and formaldehyde, of benzenesulfonic acid, formaldehyde and naphthalinic acid, of naphthalenesulfonic acid and formaldehyde or of naphthalenesulfonic acid, dihydroxydiphenylsulfone and formaldehyde. The disodium salt of bis(6-sulfonaphthyl-2-)methane is preferred.

Mixtures of anionic dispersants can also be used. Usually the anionic dispersants are present in the form of their alkali metal salts, ammonium salts or amine salts. These dispersants are preferably used in an amount of 0.1 to 5 g/l of liquor.

Depending on the dye to be used and on the substrate, the dyebaths or whitener liquors may additionally contain, besides the auxiliaries already mentioned, customary additives, conveniently electrolytes such as salts, typically sodium sulfate, ammonium sulfate, sodium phosphates or polyphosphates or ammonium phosphates or polyphosphates, metal chlorides or metal nitrates such as sodium chloride, calcium chloride, magnesium chloride, or calcium nitrate, ammonium acetate or sodium acetate and/or acids, including mineral acids such as sulfuric acid or phosphoric acid, or organic acids, conveniently lower aliphatic carboxylic acids such as formic acid, acetic acid or oxalic acid, as well as alkalies or alkali donors and/or chelating agents.

The acids are used in particular for adjusting the pH of the liquor used in the practice of this invention. The pH is normally in the range from 3 to 6.5, preferably from 4.5 to 6.

When dyeing with reactive dyes, the formulations usually contain fixing alkalies.

The alkalies used for fixing the reactive dyes are typically sodium carbonate, sodium hydrogencarbonate, sodium hydroxide, disodium phosphate, trisodium phosphate, borax, aqueous ammonia or alkali donors such as sodium trichloroacetate. In particular, a mixture of water glass and a 30% aqueous solution of sodium hydroxide has been found to be a particularly useful alkali.

The pH of the alkali-containing dye liquors is usually in the range from 7.5 to 12.5, preferably from 8.5 to 11.5.

Dyeing or whitening is conveniently carded out from an aqueous liquor by the exhaust process. The liquor can accordingly be chosen within a wide range, typically from 1:4 to 1:100, preferably 1:6 to 1:50. The temperature at which dyeing or whitening is carried out is at least 70° C. and is normally not higher than 140° C. The preferred temperature range is from 80° to 135° C.

Linear polyester fibres and cellulose triacetate fibres are preferably dyed by the high-temperature process in enclosed and with advantage also in pressure-resistant machines at temperatures above 100° C., preferably in the range from 110° to 135° C., and under atmospheric or superatmosphere pressure. Suitable enclosed machines are typically circulation dyeing machines such as package or beam dyeing apparatus, winch becks, jet or drum dyeing machines, muff dyeing machines, paddle machines or jiggers.

Secondary acetete fibres are preferably dyed in the temperature range from 80° to 85° C. If the material to be dyed is cellulosic fibre material or synthetic polyamide fibre material alone, then dyeing is conveniently carried out in the temperature range from 20° to 106° C., preferably from 30° to 95° C. for cellulose and 80° to 95° C. for polyamide fibres.

Polyester/cotton fabrics are preferably dyed in the temperature range above 106° C., conveniently in the range from 110° to 135° C. These blended fabrics can be dyed in the presence of carders or mixtures of carriers which act as dye accelerators for dyeing the polyester component with disperse dyes.

The dyeing process can be carded out by either by briefly treating the goods to be dyed first with the novel formulation and then dyeing them or, preferably, dyeing the goods with the formulation and the dye simultaneously.

The dyeings are finished by cooling the dye liquor to 40°–70° C., rinsing the dyeings with water and, if necessary, reduction clearing them in alkaline medium in conventional manner. The dyeings are then washed once more and dried. When using carriers, the dyeings are subjected with advantage to a heat treatment, conveniently a thermosol treatment, to improve their lightfastness, which treatment is preferably carded out for 30 to 90 seconds in the temperature range from 160° to 180° C. When dyeing the cellulose component with vat dyes, the goods are treated first in conventional manner with hydrosulfite in the pH range from 6 to 12.5 and then with an oxidising agent and, finally, given a washing-off.

The dyeings obtained with the use of the novel polymers are level and strong and are distinguished by good dye yields. In particular, level dyeings are obtained, and the material is crease-free (Monsanto standard 2-4), has a level appearance and a pleasing, soft handle.

The so-called friction test can be carded out to determine the ability of a polymer to prevent creasing. In this test, a strip of fabric, e.g. a strip of cotton or cotton/polyester, is moistened with water, applied to the surface of a roller that rotates at constant speed and, using a dyanamometer, the force is measured that is needed to hold the strip of fabric in a fixed position. The value obtained is the standard (friction 100% ). The strip is then immersed in an aqueous solution of the polymer to be tested and the measurement is repeated. The values obtained without and with polymer are correlated and the friction of the polymer is expressed in percent in relation to the value obtained with pure water. Friction values of e.g. ≦70% indicate a markedly crease-reducing effect of the tested polymer.

In addition, the fastness properties of the dyeings, including lightfastness, rubfastness and wetfastness, are not adversely affected by the use of the auxiliary formulation. Also no troublesome foaming occurs when dyeing the textile material in the presence of the novel formulations.

Unless otherwise indicated, the percentages in the following Examples are by weight. The amounts of dye are based on commercial, i.e. dilute, products, and the amounts of the components of the auxiliary formulation are based on pure substance.

Auxiliary Examples

| Ex. No. | Polymer[1)] | Conc. aqu. sol. g/l | Viscosity mPa·s | Friction value CO [%] |
|---|---|---|---|---|
| 1 | acrylamide homopolymer | 0.1 | 10[2)] | 56 |
| 2 | acrylic acid/acrylamide copolymer | 0.0025 | 170[2)] | 55 |
| 3 | acrylic acid/acrylamide copolymer | 0.01 | 130[2)] | 51 |
| 4 | acrylic acid/acryl- | 0.0025 | 160[2)] | 61 |

-continued

Auxiliary Examples

| Ex. No. | Polymer[1] | Conc. aqu. sol. g/l | Viscosity mPa·s | Friction value CO [%] |
|---|---|---|---|---|
| | amide copolymer | | | |
| 5 | acrylic acid/acryl | 0.0075 | 70[3] | 54 |
| | amide copolymer | | | |
| 6 | acrylic acid/acryl-amide copolymer | 0.0038 | 100[3] | 56 |
| 7 | acrylic acid/acryl-amide copolymer | 0.01 | 100[3] | 43 |
| 8 | acrylic acid/acryl-amide copolymer | 0.01 | 50[1] | 55 |
| 9 | acrylic acid/acryl-amide copolymer copolymer | 0.025 | 50[3] | 64 |
| 10 | acrylic acid/acryl-amide copolymer | 0.005 | 300[3] | 60 |
| 11 | acrylic acid/acryl-amide copolymer | 0.01 | 600[3] | 42 |
| 12 | acrylic acid/acryl-amide copolymer | 0.01 | 500[3] | 44 |
| 13 | acrylic acid/acryl-amide copolymer | 0.025 | 50[3] | 61 |
| 14 | acrylic acid/acryl-amide copolymer | 0.025 | 75[2] | 52 |
| 15 | acrylic acid/acryl-amide copolymer | 0.045 | 50[3] | 63 |
| 16 | acrylic acid/acryl-amide copolymer | 0.04 | 200[3] | 45 |
| 17 | acrylic acid/acryl-amide copolymer | 0.025 | 115[2] | 43 |
| 18 | acrylic acid/acryl-amide copolymer | 0.01 | 130[2] | 45 |
| 19 | acrylic acid/acryl-amide copolymer | 0.01 | 600[3] | 37 |
| 20 | acrylic acid/acryl-amide copolymer | 0.005 | 500[3] | 51 |
| 21 | acrylamide homopolymer | 0.1 | 50[3] | 48 |
| 22 | acrylic acid/acryl-amide copolymer | 0.02 | 300[3] | 44 |
| 23 | acrylic acid/acryl-amide copolymer | 0.025 | 400[3] | 46 |

[1]molecular weight 0.8 to 15 million.
[2]Brookfield viscosity of a 0.1% solution of the polymer at 20° C. (60 rpm).
[3]Brookfield viscosity of a 0.1% solution of the polymer at 20° C. (5 rpm).

USE EXAMPLES

Example 24

100 g of bleached cotton cretonne fabric are dyed in 2 liters of water with the following ingredients:

0.25 g of a dye of formula (101)

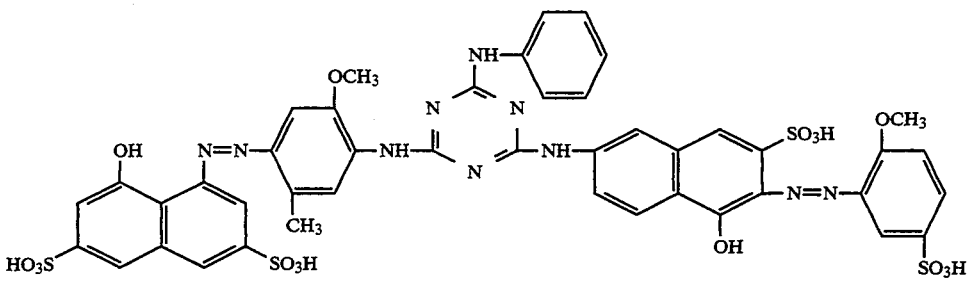

0.3 g of a dye of formula (102)

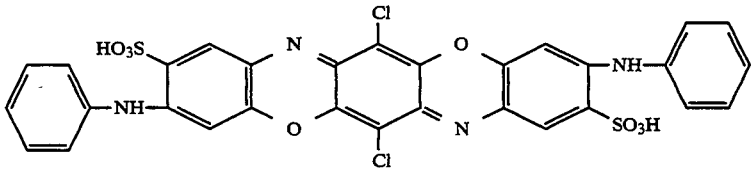

4 g of a 1% solution of the polymer of Example 16 (copolymer of c. 15% of acrylic acid and 85% of acrylamide, molecular weight c. 2 million).

These ingredients are first dissolved or dispersed in water and added to the dyebath at 50° C. Afterwards the dye liquor is heated over 30 minutes to 98° C. with constant circulation and agitation of the substrate. After 15 minutes, 20 g of Glauber's salt are added to the dyebath. The fabric is then dyed for a further 30 minutes at 98° C., after which time the dyebath is cooled to 60° C. and the fabric is rinsed with hot and cold water and dried. A crease-free, level, grey dyeing is obtained. The use of the novel formulation markedly lowers the friction value compared with a dye liquor to which this auxiliary has not been added. The formulation containing the copolymer does not have a retarding action and also does not cause a change in shade.

Comparably good results are obtained by repeating the above described procedure and replacing 4 g of the 1% solution of the polymer of Example 16 with 8 g of a 0.1% solution of the acrylamide/acrylic acid copolymer of Example 8.

Example 25

100 g of polyester staple fabric are treated on a winch beck at 30° C. with 2 liters of an aqueous dye liquor comprising 0.25 g of a dye of formula (103)

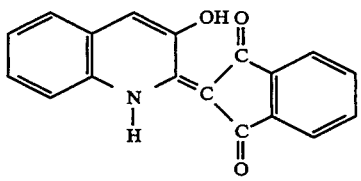

0.35 g of a dye of formula

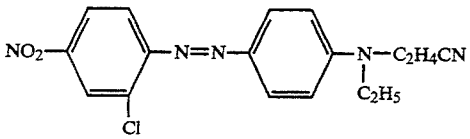

(104)

0.15 g of a dye of formula

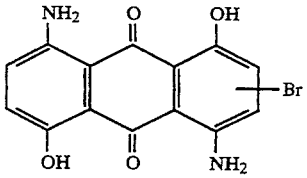

(105)

2 g of a 1% solution of the polymer of Example 16 (copolymer of c. 15% acrylic acid and 85% of acrylamide, molecular weight c. 2 million). 2 g of ammonium sulfate and which has been adjusted to pH 5.5 with formic acid. After a preliminary running of the goods for 10 minutes at 30° C. the temperature is raised to 130° C. and the fabric is dyed for 60 minutes at this temperature. The liquor is then cooled to 60° C., and the dyed goods are rinsed and dried. A crease-free, level brown dyeing is obtained.

Comparable results are obtained by replacing the polymer of Example 16 with an equivalent amount of the polymer of one of Examples 2 to 15, 17 to 20, 22 or 23.

Example 26

100 g of a polyamide 66 staple fabric are treated on a laboratory jet dyeing machine at 40° C. in 2 liters of water with the following ingredients:

6 g of a 1% aqueous solution of the polymer of Example 21 (polyacrylamide homopolymer, molecular weight c. 10 million);

2 g of a condensate of 1 mol of fatty amine and 70 mol of ethylene oxide;

The liquor is adjusted to pH 5.5 with acetic acid. After a preliminary running of the goods for 15 minutes at 40° C., 1 g of a dye of formula

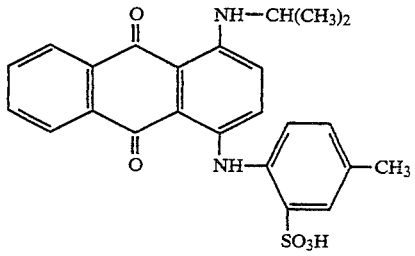

(106)

is added to the liquor, which is allowed to circulate for a further 5 minutes. The liquor is heated over 30 minutes to 98° C. and and dyeing is carried out for 30 minutes at this temperature.

The liquor is cooled over 15 minutes 60° C. and the dyed fabric is dried. A crease-free. level, blue dyeing is obtained. No change of shade occurs.

Comparable results are obtained by using an equivalent amount of the polymer of Example 1 instead of the polymer of Example 21.

What is claimed is:

1. A process for dyeing textile fiber material, which comprises dyeing said textile fiber material by an exhaust process using a dye liquor containing an anticrease agent, which anticrease agent is an acrylamide copolymer consisting essentially of 75 to 90 weight percent acrylamide monomer and 10 to 25 weight percent acrylic acid monomer, and which anticrease agent is present in an amount of less than 0.04 grams per liter of the dye liquor.

2. A process according to claim 1, wherein the acrylamide copolymer is in the form of an aqueous formulation.

3. A process according to claim 1, wherein the acrylamide copolymer has a molecular weight of 800 000 to 15 million.

4. A process according to claim 1, wherein the acrylamide copolymer has a molecular weight of 1.5 to 3 million.

5. A process according to claim 1, wherein 0.0005 to 0.03 g/l of liquor of the acrylamide copolymer is used.

6. A process according to claim 1 for dyeing textile fibre material containing cellulosic fibres, synthetic polyamide fibres or polyester fibres.

7. A process according to claim 1 for dyeing polyester-containing textile fibre material with a disperse dye in the temperature range from 80° to 135° C.

8. A process according to claim 1 for dyeing polyacrylonitrile fibres with cationic dyes.

9. A process for preventing the formation of running creases when dyeing a woven and knit fabric in a closed dyeing machine, which comprises dyeing said fabric in the presence of an aqueous formulation of an acrylamide copolymer according to claim 1.

* * * * *